US005107933A

United States Patent [19]

Wuhrer

[11] Patent Number: 5,107,933

[45] Date of Patent: Apr. 28, 1992

[54] HYDRAULIC DRILLING OUTFIT

[75] Inventor: Wolfgang Wuhrer, Ravensburg, Fed. Rep. of Germany

[73] Assignee: Sulzer Brothers Limited, Winterthur, Switzerland

[21] Appl. No.: 604,051

[22] Filed: Oct. 26, 1990

[30] Foreign Application Priority Data

Nov. 8, 1989 [CH] Switzerland ..... 4027/89

[51] Int. Cl.[5] ..... E21C 5/10

[52] U.S. Cl. ..... 173/1; 173/39; 173/77; 173/79; 173/161

[58] Field of Search ..... 173/39, 77, 72, 79, 173/161, 163, 165, 169, 170, 66, 59, 18, 37, 1

[56] References Cited

U.S. PATENT DOCUMENTS

| | | | |
|---|---|---|---|
| 1,164,496 | 12/1915 | Gilman | 173/79 |
| 2,599,042 | 6/1952 | Bannister | 173/59 |
| 2,908,482 | 10/1959 | Curtis et al. | 173/161 |
| 2,964,305 | 12/1960 | Samhammer et al. | 173/39 |
| 3,132,703 | 5/1964 | Larcen | 173/77 |
| 3,203,489 | 8/1965 | Fuehrer | 173/161 |
| 4,010,806 | 3/1977 | Broadbent | 173/57 |
| 4,024,923 | 5/1977 | Broadbent | 173/57 |
| 4,712,624 | 12/1987 | Mashimo | 173/39 |

FOREIGN PATENT DOCUMENTS

| | | |
|---|---|---|
| 0145701 | 6/1985 | European Pat. Off. . |
| 3708616 | 9/1988 | Fed. Rep. of Germany . |
| 2037630 | 7/1980 | United Kingdom . |

*Primary Examiner*—Frank T. Yost
*Assistant Examiner*—Scott A. Smith
*Attorney, Agent, or Firm*—Kenyon & Kenyon

[57] ABSTRACT

A hydraulic drilling outfit has a hydraulically driven hammer drill which is fastened pivotally to a hydraulic thrust unit. A control for the hydraulics utilizes the flushing water for the drill bit as the power-source for all of the motions executed by the drilling outfit. One hydraulic supply line to the control of the thrust unit and one line from the control to the hammer drill are sufficient for operating the system in an open circuit. A rotary slide valve simultaneously controls the thrust and withdrawal motions as well as the operational states of drilling and not drilling. The desired value adjustment for the speed of thrust is arranged on the rotary slide valve.

7 Claims, 3 Drawing Sheets

FIG. 2
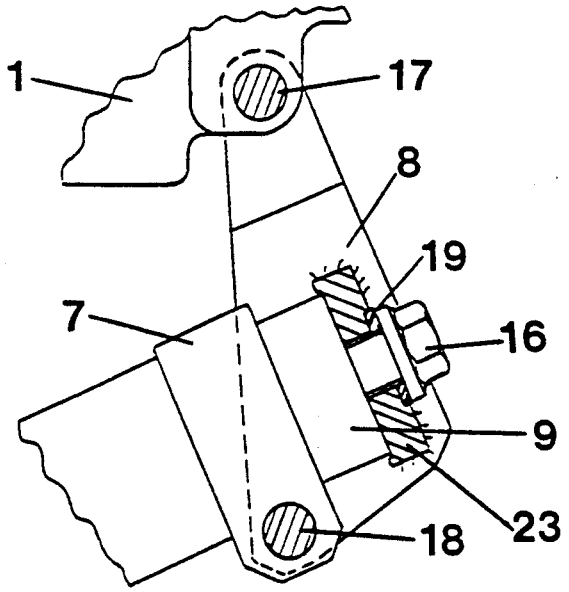
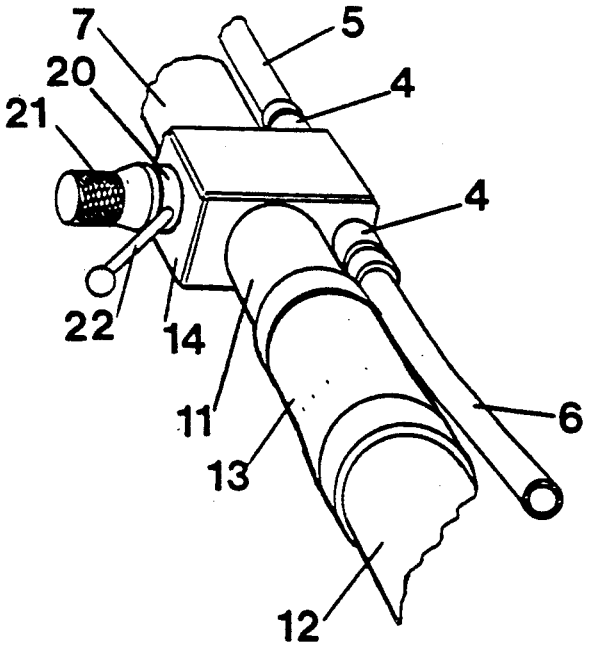
FIG. 3

HYDRAULIC DRILLING OUTFIT

This invention relates to a hydraulic drilling outfit. More particularly, this invention relates to a hydraulic control arrangement for a hydraulic drilling outfit.

As is known, various types of hydraulic drilling machines have been used for rock drilling, particularly for drilling holes in mine roofs in order to form bolt holes For example, U.S. Pat. No. 4,010,806 describes rock drilling equipment which is erected in an upright position for the drilling of a hole in a roof of a mine. The equipment includes multiple hoses for feeding hydraulic fluid under pressure to and from the equipment components. One such hose is used to deliver hydraulic fluid to a telescopic cylinder body in order to displace telescopic components against the ground while a drill rod carried by a drill bit engages the roof of the mine. The hose also delivers the hydraulic fluid over a valve to a hydraulic motor which serves to actuate the drill rod. A second hose is used for removing the hydraulic fluid from the telescopic components while a third hose operates as a return line. In addition, water can be supplied by means of a further hose for dust suppression and swarf removal.

U.K. Patent Application 2,037,630 describes a hydraulic drilling machine which employs a feed motor constructed as a piston and cylinder unit having a pair of lines connected to a pressure oil supply and tank in order to provide for reciprocation of the cylinder. In addition, a third line is provided to supply flushing medium to the drill rod.

Other types of drilling machines are described in German O.S. 3708616 and E.P.A. 0145701.

In addition to the above types of machines involving hydraulic arrangements, other types of drilling outfits are known. For example, a survey of the state of the hydraulic drilling outfits is to be found in the article "Hydraulic Rockdrills" by Joffrey Pearse (Mining Magazine—March 1985, pages 221 to 231, Mining Journal Ltd., 60 Worship Street, London EC2A 2HD) in which various manufacturers' products and their application are described.

In summary, telescopic cylinders for the generation of the thrust and withdrawal motions are known for hand-actuated hammer drills and for drilling outfits on mounts. Also, hydraulic thrust and withdrawal mechanisms on hammer drills have hitherto been driven by oil or by water emulsions as elements of closed hydraulic circuits. Usually, drilling with these outfits is very dependent upon the maximum distance from the oil or liquid supply which delivers the necessary power to the flows of liquid. Besides the flushing lines for the drill bit, the drill drive and thrust regulation are often supplied via separate pressure lines so that together with the return lines, a plurality of more or less flexible lines lie in the region of operation of the drilling outfit.

These lines, however, impede the possibilities of movement. The lines must not be damaged and must let themselves be pulled along to correspond with the advance of the drilling outfit. Hitherto, closed circuits have been necessary because of inflammability or because of the costs in the case of power-bearers provided with lubricant additives. Because of pressure drops from increased viscosity as well as the outlay upon driving liquid, a hydraulic supply unit must be mounted at the shortest possible distance of a maximum of a few hundred meters from the drilling outfit, e.g., on the same level of a mine.

According, it is an object of the invention to reduce the number of flexible supply lines for a hydraulic drilling outfit.

It is another object of the invention to reduce the number of flexible internal connecting lines within a hydraulic drilling outfit.

It is another object of the invention to be able to choose the location of supply equipment for a hydraulic drilling outfit over a wide limit.

It is another object of the invention to be able to position the supply equipment for a hydraulic drilling outfit in a mine at ground level.

Briefly, the invention provides a hydraulic drilling outfit which is comprised of a hydraulically driven hammer drill having a drill bit, a hydraulic thrust unit connected to the hammer drill for hydraulically advancing the hammer drill and a hydraulic control means for actuating the thrust unit hydraulically In accordance with the invention, a single hydraulic supply line extends to the control means for delivery of hydraulic fluid to the control means for actuating the thrust unit. In addition, a single hydraulic supply line is connected between the control means and the hammer drill to deliver hydraulic fluid to the drill for driving of the drill bit and flushing of the bit.

In this construction, cooling and flushing water for the drill bit is employed as the power-bearer for all of the motions performed by the drilling outfit. Further, this water is supplied by one single hydraulic supply line from outside the drilling outfit.

Any geodetic head which is required for the drive of the drilling outfit may be generated by booster pumps located anywhere between a water reservoir and the drilling outfit, for example, downstream of a pump which delivers the water to the drilling outfit from the reservoir. In this case, the flush and water network would be constructed in a stronger manner so as to correspond with any rise in pressure.

The hydraulic drilling outfit is thus equipped with a minimum of supply lines. This, in turn, facilitates handling. Also, through the employment of flushing water as the power source for the drill, no further electric motors or combustion engines with their necessary infrastructure are necessary at the work face or below ground. Further, for drilling at the work face, no outlay is necessary below ground for an electric power supply or for exhaust lines from combustion engines.

These and other objects and advantages of the invention will become more apparent from the following detailed description taken in conjunction with the accompanying drawings wherein:

FIG. 1 diagrammatically illustrates a side elevational view of a hydraulic drilling outfit having a hammer drill and thrust unit in accordance with the invention;

FIG. 2 illustrates an enlarged detail view of a connection between the hammer drill and thrust unit of FIG. 1;

FIG. 3 illustrates an enlarged view of a part of the thrust unit and a control means for driving the thrust unit in accordance with the invention.

Figure 1:
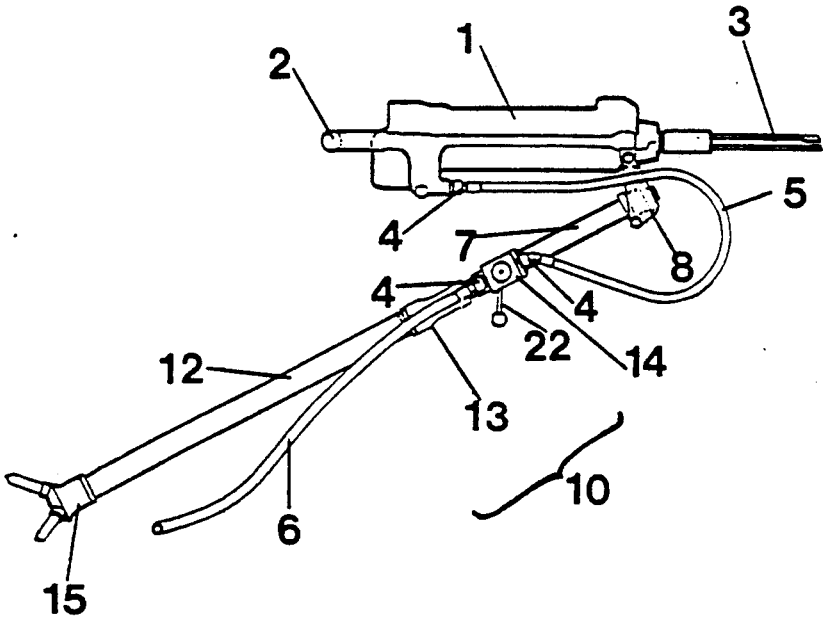

Referring to FIG. 1, the hydraulic drilling outfit includes a hydraulically driven hammer drill 1 having a handle 2 at one end and a drill bit 3 at the opposite end.

In addition, the drilling outfit has a hydraulic thrust unit 10 connected to the hammer drill 1 for hydraulically advancing the hammer drill 1. As indicated, the thrust unit 10 includes a positioning cylinder 12 with a double-acting piston which bears against the ground via a foot 15. Referring to FIG. 3, the cylinder 12 houses a piston rod 11 which extends through a cylinder cover 13 to be connected to a hydraulic control means 14.

Referring to FIG. 1, an intermediate piece 7 extends from the control means 14 so as to hingedly secure the thrust unit 10 via a hinge connection to the hammer drill 1. As illustrated in FIG. 2, the hinge connection includes a transmission piece 8 which is pivotally connected by a hinge pin 17 to the hammer drill 1 at one end and by a hinge pin 18 at an opposite end to the connecting piece 7. In addition, the hinge connection includes a damping means for damping forces transmitted between the thrust unit 10 and the hammer drill 1 in a thrust direction and a withdrawal direction. The damping means may also be adjustable in order to damp these forces differentially in the thrust and withdrawal directions. As illustrated in FIG. 2, the damping means includes a damping device 9 mounted on the intermediate piece 7, a connecting web 23 secured to the transmission piece 8, a holding screw 16 which is threaded into the damping device 9 through the web 23 and a damping disc 19 between a head of the screw 16 and the connecting web 23.

Referring to FIG. 1, a single hydraulic supply line 6 extends from a reservoir of hydraulic fluid (not shown) to the control means 14 in order to deliver hydraulic fluid, e.g. water, to the control means 14 in order to drive the thrust unit 10. As indicated in FIG. 3, the supply line 6 is connected via a suitable coupling 4 to the control means 14. The thrust and withdrawal motions for the hammer drill 1 are transmitted via the guided piston rod 11 to the housing of the control means 14 and reproduced at the hammer drill 1 through the intermediate piece 7 and the hinge connection. The faces of the piston 11 are acted upon by pressure through channels in the hollow piston rod 11 first on the side next to the bearing foot 15 and, secondly, on the side next to the cylinder cover 13.

As illustrated in FIG. 1, a single hydraulic line 5 is connected to and between the control means 14 and the hammer drill 1 in order to deliver hydraulic fluid to the drill bit 3 for driving of the drill 1 as well as for flushing of the drill bit 3. As indicated, the supply line 5 is connected to the housing of the control means 14 by a coupling 4 and to the housing of the hammer drill 1 by a coupling 4. Since the internal connections within the hammer drill for the driving of the drill bit 3 and the flushing of the drill bit 3 are either conventional with piston or hydromotor or are subject of another invention with a turbine drive, no further description is believed to be warranted. By way of example, a suitable hammer drill is described in pending U.S. Pat. Application Ser. No. 07/453,394, filed Dec. 19, 1990.

Figure 4:
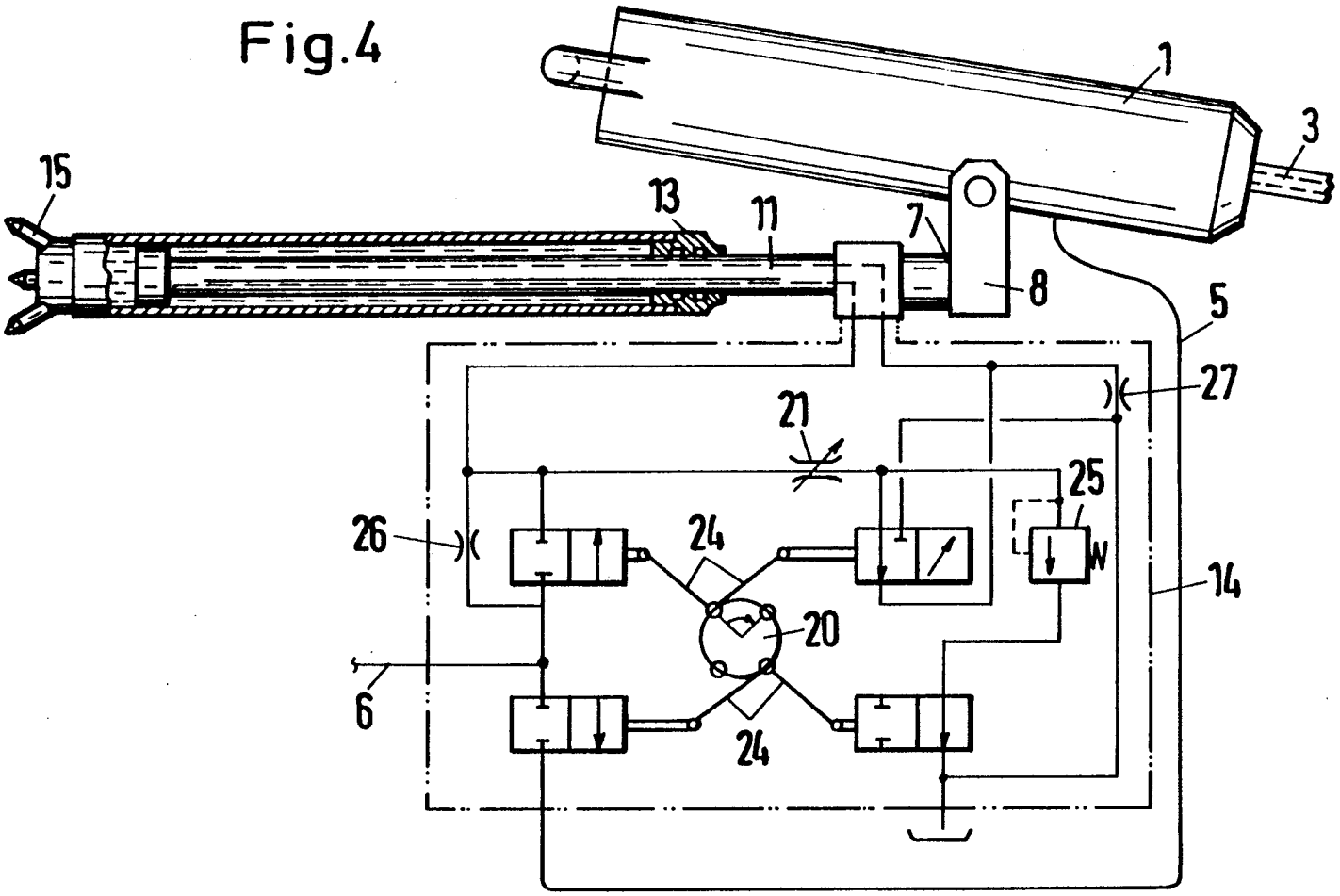
FIG. 4 diagrammatically illustrates the internal connections and functions of a control means in accordance with the invention.

Referring to FIGS. 3 and 4, a rotary slide valve 20 is provided in the control means 14 for selectively connecting the external supply line 6 to the internal supply line 5. As indicated, the valve 20 has an actuating lever 22 which is movable between one terminal position to effect a thrust motion of the thrust unit 10 while connecting the supply lines 6, 5 to each other and a second terminal position to effect a withdrawal motion of the thrust unit 10 while disconnecting the supply lines 6, 5 from each other.

In use, the cooling and flushing water for the drill bit 3 is employed as the sole power source for all of the motions performed by the drilling outfit. Once the drilling unit has been set in place, for example for drilling a bore hole in a wall of a mine, water is supplied via the main hydraulic supply line 6 to the housing of the control means 14. The water is then delivered under pressure to the hollow piston rod 11 by suitable passages as well as through the slide valve 20 to the secondary supply line 5 to the hammer drill 1. At this time, thrust and withdrawal motions are transmitted through the intermediate piece 7 and reproduced at the hammer drill 1.

The reversal of control between the thrust motion and the withdrawal motion can be performed by turning the actuating lever 22 past a neutral blocking angle between the two terminal positions thereon. The hydraulic supply line 5 with the power and flushing water to the hammer drill 1 is blocked as soon as the rotary slide valve 20 is turned from the thrust range into the neutral blocking angle.

FIG. 4 schematically illustrates how the rotary slide valve 20 can simultaneously fulfill the function of four valves, each of which has two terminal positions. The connecting levers 24 between the valve 20 and the function symbols indicate the logic by means of which the valves are linked together when the valve 20 is operated. In the illustrated counter clockwise terminal position, the hammer drill and thrust motion are actuated whereas in the clockwise terminal position of the valve 20 indicated by dotted lines, the hammer is blocked for withdrawal motion.

The maximum speed of thrust can be predetermined through alteration of a throttle by the desired value being set by turning a thrust setting 21 (see FIGS. 3 and 4) which, for operational reasons, is preferably built onto the rotary slide valve 20 itself. The thrust is determined by the ratio of the piston surfaces, by throttles 26, 27, 29 and by a pressure relief valve 25.

The hydraulic supply lines 6 5 are disposed within an open circuit. Thus, the flushing water can be flushed from the drill bit 3 into the surrounding environment. Also the leaking water from the control means 14 can be spread to the surrounding environment as it is harmless.

The invention thus provides a hydraulic drilling outfit which uses a minimum of flexible lines for the delivery of hydraulic fluid for operating the outfit. Further, the line serves to deliver hydraulic fluid which can be used for operating the drill and for flushing the drill bit.

The invention further provides a hydraulic drilling outfit which can be readily mounted in place and moved about from drilling position to drilling position without interference from a multiplicity of supply and return lines The embodiments of the invention in which an inclusive property or privilege is claimed are defined as follows:

1. A hydraulic drilling outfit comprising a hydraulically driven hammer drill having a drill bit;

a hydraulic thrust unit connected to said hammer drill for hydraulically thrusting said hammer drill;

a hydraulic control means for actuating said thrust unit hydraulically;

a first hydraulic supply line extending to said control means for delivery of hydraulic fluid to said control means to actuate said thrust unit; and a second hydraulic line connected between said control means and said hammer drill to deliver hydraulic fluid from said control means to said drill for driving of said drill bit and flushing of said bit.

2. An outfit as set forth in claim 1 which further comprises a hinge connection connecting said thrust unit to said hammer drill, said hinge connection including damping means for damping forces transmitted between said thrust unit and said hammer drill in a thrust direction and a withdrawal direction.

3. An outfit as set forth in claim 2 wherein said damping means is adjustable to damp said forces differentially in said thrust direction and said withdrawal direction.

4. An outfit as set forth in claim 1 further comprising a rotary slide valve in said control means for selectively connecting said first supply line to said second line, said valve having an actuating lever movable between one terminal position to effect a thrust motion of said thrust unit while connecting said lines to each other and a second terminal position to effect a withdrawal motion of said thrust unit while disconnecting said lines from each other.

5. An outfit as set forth in claim 4 which further comprises an adjustable throttle connected to said control means for adjusting said thrust motion.

6. An outfit as set forth in claim 1 wherein said lines are disposed in an open hydraulic circuit.

7. A method of operating a hydraulic drilling outfit having a hydraulically driven hammer drill with a drill bit and a thrust unit for driving the hammer drill, said method comprising the steps of delivering a single flow of hydraulic fluid to the thrust unit for driving of the thrust unit; and selectively delivering the flow of hydraulic fluid to the hammer drill for driving of the hammer drill bit, cooling of the drill bit and flushing of the drill bit.

* * * * *

UNITED STATES PATENT AND TRADEMARK OFFICE

CERTIFICATE OF CORRECTION

PATENT NO. : 5,107,933

DATED : April 28, 1992

INVENTOR(S) : W. Wuhrer

It is certified that error appears in the above-identified patent and that said Letters Patent is hereby corrected as shown below:

Column 2, line 24, change "supply line" to -line-;

Column 3, line 47, change "drill bit 3" to -drill 1-;

3, line 47, change "drill 1" to -drill bit 3-;

Column 4, line 40, change "29" to -21-.

Signed and Sealed this

First Day of February, 1994

Bruce Lehman

*Attest:*

BRUCE LEHMAN

*Attesting Officer*

*Commissioner of Patents and Trademarks*